US005391098A

United States Patent [19]

Ohashi

[11] Patent Number: 5,391,098

[45] Date of Patent: Feb. 21, 1995

[54] METHOD OF MOUNTING FUSE HOLDING CLIPS FOR A FUSE HOLDER

[75] Inventor: Kozi Ohashi, Saitama, Japan

[73] Assignee: Kyoshin Kogyo Co., Ltd., Japan

[21] Appl. No.: 49,552

[22] Filed: Apr. 19, 1993

[30] Foreign Application Priority Data

Apr. 20, 1992 [JP] Japan ..... 4-125480

[51] Int. Cl.[6] ..... H01R 4/48

[52] U.S. Cl. ..... 439/830; 439/78

[58] Field of Search ..... 439/78, 83, 830, 833, 439/845, 849, 572, 621, 622

[56] References Cited

U.S. PATENT DOCUMENTS 2,229,989 1/1941 Roby ..... 439/830
2,738,486 3/1956 Wadsworth ..... 439/830
4,052,688 10/1977 Denigris et al. ..... 439/830 X
5,044,965 9/1991 Hayasaka ..... 439/830 X
5,199,887 4/1993 Iacono ..... 439/83

FOREIGN PATENT DOCUMENTS 0571581 8/1945 United Kingdom .

*Primary Examiner*—Khiem Nguyen
*Attorney, Agent, or Firm*—Pearne, Gordon, McCoy & Granger

[57] ABSTRACT

A method of mounting fuse holding clips for a fuse holder on a circuit board by such an automatic part inserter as is used for inserting radial parts and comprising a step of inserting a fuse holding clip by the automatic inserter while at least one direction detector provided on the fuse holding clip is extended through an extending hole if the fuse holding clip is inserted in a correct direction.

8 Claims, 9 Drawing Sheets

METHOD OF MOUNTING FUSE HOLDING CLIPS FOR A FUSE HOLDER

BACKGROUND OF THE INVENTION

This invention relates to a method of mounting fuse holding clips for a fuse holder on a circuit board and more particularly an improvement on a method of mounting fuse holding clips by an automatic part inserter after they are cut away from a lead frame including a plurality of fuse holding clips having mounting legs to extend through mounting holes in the circuit board and to be securely mounted on the circuit board by a soldering layer.

In general, there has been used an automatic part inserting machine which mechanically inserts a plurality of fuse holding clips at their mounting legs in mounting holes in a circuit board in a continuous manner.

There has been also used an assembly of fuse holding clips to be mounted on the circuit board by such an automatic part inserting machine. Such an assembly of fuse holding clips may be referred to as taped clips and comprises a lead frame having a perforation engaging feeding pawls of a sprocket of the automatic part inserter with the fuse holding clips at their mounting legs integrally extending from the lead frame in a spaced manner.

Each of the fuse holding clips comprises a resiliently fuse holding clip body including mounting legs integrally provided thereon. The clip body comprises a generally U-shaped curved piece for resiliently holding one of bases of a fuse such as a cartridge fuse and an upper base receiving opening provided at the end of the curved piece and widened toward its upper edges.

The automatic part inserting machine feeds the taped clips to a clip mounting position by rotation of its sprocket and removes the respective fuse holding clips at their mounting legs out of the taped clips by holding them by means of a chuck of the machine and cutting them by means of a cutter thereof.

Thereafter, the machine pushes down the respective fuse holding clips by a pusher of the machine while inserting the mounting legs of the fuse holding clips into the mounting holes in the circuit board until an outer bottom of the U-shaped curved piece engages the upper face of the circuit board.

Finally, the mounting legs of the fuse holding clip are clinched by a clincher of the machine so that they are bent along an underside side of the circuit board toward an electrically conducting layer thereon and soldered thereto so that they are electrically and mechanically connected to the electrically conducting layer.

As shown in FIG. 18, such fuse holding clips 12 have a pawl-like base engaging tab 26 provided on the clip body and serving as a stop so that the cartridge fuse 45 held by the fuse holder is never axially removed out of the fuse holder.

This means that the fuse holding clips 12 have to be mounted on the circuit board 36 in such a correct direction as the base engaging tab 26 of the faced fuse holding clips 12 and 12 are disposed outside the fuse held by the fuse holder in a symmetrical manner as shown in FIG. 18.

However, the mounting legs (not shown) of the fuse holding clips 12 are provided along their axis in a spaced manner regardless of the direction in which the fuse holding clips 12 are to be mounted. Thus, if the insertion program or a cartridge in which the fuse holding clip assembly is contained is set in a reverse direction, then the fuse holding clips 12 are mounted in an incorrect direction as shown in FIG. 20.

This disables the cartridge fuse 46 to be held by the fuse holder because the base engaging tabs 26 prevent the fuse 46 from being inserted into the fuse holding clips 12.

Furthermore, in this case, since the fuse holding clips 12 should be removed out of the circuit board and again mounted thereon, the operation of mounting the fuse holder is disadvantageously troublesome.

SUMMARY OF THE INVENTION

Accordingly, it is a principal object of the invention to provide a method of mounting a fuse holder adapted to prevent fuse holding clips of the fuse holder from being mounted on a circuit board in an incorrect direction.

It is another object of the invention to provide a method of mounting a fuse holder in a circuit board so as to allow a cartridge fuse to be positively held by the fuse holder.

It is a further object of the invention to provide a method of mounting a fuse holder in a circuit board in a more effective manner.

In accordance with one aspect of the present invention, there is provided a method of mounting fuse holding clips for a fuse holder on a circuit board by an automatic part inserter which inserts mounting legs of said fuse holding clips into mounting holes in a circuit board, respectively, said fuse holding clips each having a stop provided on a clip body of said fuse holding clips so that a cartridge fuse held by said fuse holder is never axially removed out thereof, said method is characterized by comprising a step of inserting each of said fuse holding clips by the automatic inserter while a direction detector provided on said fuse holding clips extends through an extending hole in said circuit board if said fuse holding clips are inserted in a correct direction.

In accordance with another aspect of the invention, there is provided a fuse holding clip comprising a resiliently fuse holding clip body including a generally U-shaped curved piece and mounting legs integrally provided on said curved piece to extend through mounting holes in a circuit board, said fuse holding clip characterized by comprising a direction detector provided on said clip body so as to extend throug an extending hole in said circuit board if said fuse holding clip is mounted on said circuit board in a correct direction.

The fuse holding clips may be provided in the form of tape-like assembly and the automatic part inserting machine may insert the fuse holding clips into the mounting holes in the circuit board by the pusher of the automatic part inserting machine after they are cut away from the tape-like clip assembly by a cutter thereof.

With such a direction detector provided on the clip body of the fuse holding clips, if an operator tries to mount them on a circuit board in an incorrect direction so that the stop is disposed in a reverse direction, then the direction detector strikes the circuit board so that it cannot extend therethrough. This prevents the fuse holding clips at their mounting legs from being inserted into the mounting legs in the incorrect direction.

BRIEF DESCRIPTION OF THE DRAWINGS

The above and other objects and features of the invention will be apparent from the description of the embodiment of the invention taken along with the accompanying drawings in which.

DETAILED DESCRIPTION OF THE EMBODIMENT

Figure 1:
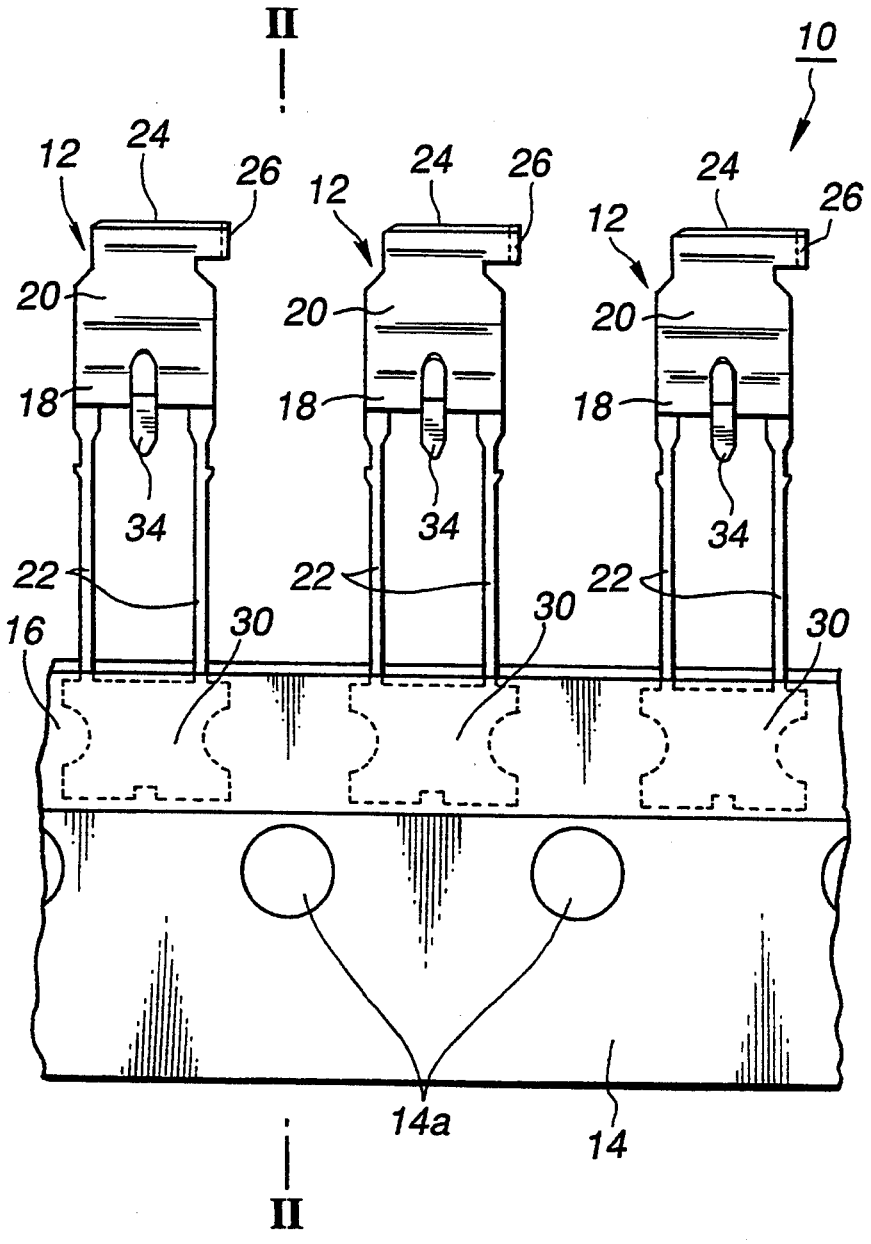
FIG. 1 is a front view of a tape-like assembly of fuse holding clips constructed in accordance with the invention.
Figure 2:
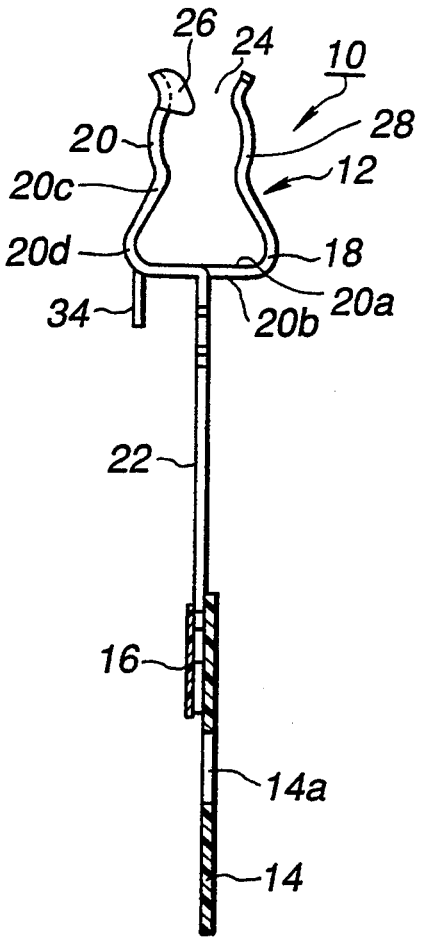
FIG. 2 is a cross sectional view of the tape-like assembly taken along the line II—II of FIG. 1.

Referring now to FIGS. 1 and 2, there is shown a tape or tape-like assembly 10 in the form of leading frame or taped parts comprising a plurality of fuse holding clips 12 for fuse holders which may be formed of electrically conducting metal such as copper, brass, copper alloy or the like constructed in acordance with the invention and mechanically connected with each other in a spaced manner. In general, such an assembly is referred to as taped clips or clip tape.

In the illustrated embodiment, the clip tape 10 comprises a supporting tape portion 14 which may be of paper or plastic material and has a perforation including a plurality of holes **14*a* provided at a distance corresponding to a distance between adjacent teeth (feeding pitch) of a sprocket type feeder of an automatic part inserting machine not shown and an adhering tape portion 15 which may be of paper film and adheres the fuse holding clips 12 onto the supporting tape portion 14 so that the clips 12 are securely held between the supporting tape portion 14 and the adhering tape portion 16**.

Figure 4:
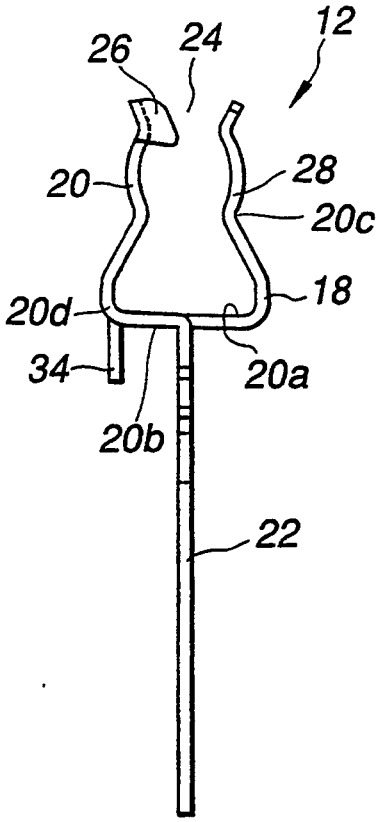
FIG. 4 is an enlarged side elevational view of one fuse holding clip of the invention cut off from the taped fuse holding clips.

As shown in FIG. 4, each of the fuse holding clips 12 comprises a clip body 18 including a generally U-shaped curved piece 20 for resiliently holding a fuse such as a cartridge fuse thereon in a manner spaced from an inner bottom **20*a* thereof and mounting legs 22 extending integrally from the curved piece 20 to extend through mounting holes in a circuit board such as a printed circuit board, which will be described later with reference to FIGS. 11 through 13**.

The mounting legs 22 are used to electrically and mechanically connect the fuse holding clips 12 to an electrically conducting layer of copper foil adhered to the circuit board in a predetermined pattern by a soldering layer which will be also described in detail later.

The U-shaped curved piece 20 has a base receiving opening 24 provided at upper edges thereof and serving to receive bases of the cartridge fuse therethrough. The clip body 18 also has a base engaging tab 26 extending integrally from one of upper edges of the curved piece 20 and serving as a stop by engaging an end face of one of the fuse base ends so that the cartridge fuse is prevented from being removed out of the fuse holder which will be understood to be formed of two spaced fuse holding clips 12.

The U-shaped curved piece 20 also has a round portion 28 formed and sized to resiliently hold one of the bases of the fuse in a manner spaced from an inner bottom **20*a* of the curved piece 20. The round portion 28 is formed of narrowed strip portions 29*c* of the curved piece 20**.

Returning to FIG. 1, each of the fuse holding clips 12 may also comprise a carrier portion 30 extending integrally from the mounting legs 22. It will be noted that the carrier portions 30 of the fuse holding clips 12 may be integrally formed with each other as shown in FIG. 3 so that they continue at their carrier portions 30 in the form of leading frame or clip strip 32.

Figure 3:
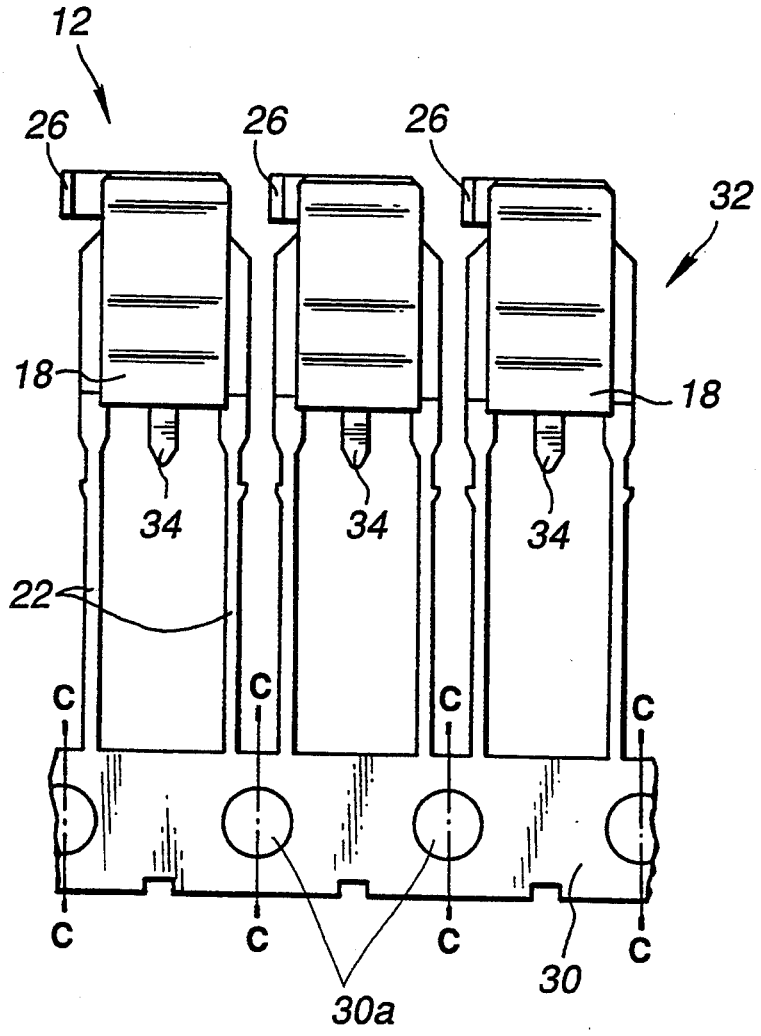
FIG. 3 is a front view of a fuse holding clip strip including a plurality of fuse holding clips integrally formed by punching and stamping a strip of electrically conducting metal in the form of leading frame and used for forming the assembly of FIG. 1.

Each of the fuse holding clips 12 is separated by cutting the leading frame 32 of FIG. 3 along a line c—c at portions between the adjacent fuse holding clips 12 and held between the supporting tape portion 14 and the adhering tape portion 16 so that the tape-like clip assembly 10 is assembled.

It will be understood that the clip strip 32 in the form of leading frame with the fuse holding clips 12 intergrally formed at their carrier portions 30 can be easily formed by punching and stamping a metal strip such as copper alloy strip. As noted from FIG. 1, a distance between the adjacent fuse holding clips 12 is equal to that between the adjacent holes **14*a* of the perforation and each of the fuse hloding clips 12 is positioned just in the middle of the adjacent holes 14*a***.

It is because a space between the adjacent fuse holding clips of the tape-like clip assembly 10 is to be made equal to a space between the adjacent teeth of the sprocket type feeder that the clip strip 32 in the form of leading frame shown in FIG. 3 is separately cut into a plurality of fuse holding clips 12, which are thereafter held between the supporting tape portion 14 and the adhering tape portion 16 so that they are positioned at a distance different from that of the leading frame of FIG. 3. In FIG. 3, a numeral 30*a* designates holes in the leading frame 30 for feeding it by a feeding device such as sprocket.

It will be understood by those skilled in the art that the leading frame of FIG. 3 may be used as tape-like clip assembly 10, but it should be noted that in this case, the leading frame of FIG. 3 is required to have such a space between the adjacent fuse holding clips 12 and therefore between the adjacent holes 30*a* for the feeding perforation as is equal to the space between the adjacent teeth of the sprocket type feeder.

As shown in FIGS. 1 through 4, the U-shaped curved piece 20 further comprises a direction detector 34 in the form of short leg extending integrally from the clip body 18 in a downward direction so that it projects from the bottom 20*b* of the curved piece 20. The direction detector 34 serves to detect whether the fuse holding clip 12 is mounted on the circuit board 36 in a correct direction as described in detail later.

Figure 7:
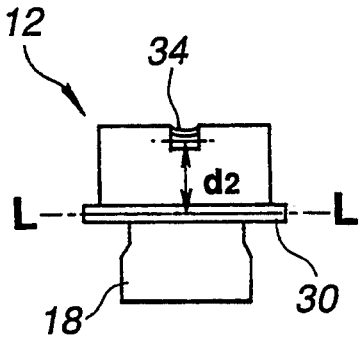
FIG. 7 is an enlarged bottom view of the clip strip portion of FIG. 5.

As shown in FIGS. 1 and 3, the direction detector 34 may preferably be provided between the mounting legs 22. As shown in FIGS. 4 and 7, the direction detector 34 is essentially provided so that it is biased out of a line bonding the two mounting legs 22 as indicated by a line L—L in FIG. 7. The direction detector 34 may be formed by punching and bending a bottom wall of the curved piece 20 when the clip body 18 is formed by stamping.

Figure 18:
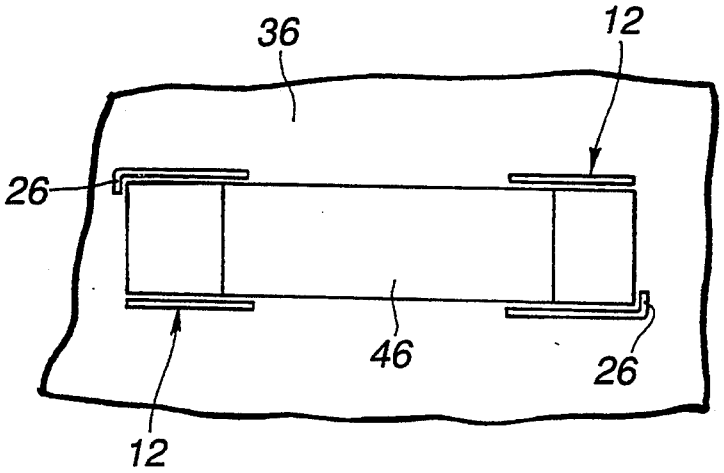
FIG. 18 schematically illustrates the fuse holder mounted on the circuit board in the correct direction.

It should be understood that the direction detector 34 may be preferably so provided on the side having one of the side walls 20*d* of the curved piece 20 that it is positioned inside the corresponding side wall 20*d* adjacent to the bottom thereof as shown in FIG. 4, which prevents the fuse holding clips 12 from being mounted on the circuit board while having a large occupation area thereof. Furthermore, the direction detector 34 may be preferably biased out of the line L—L (FIGS. 7 and 18) by a distance ds which is half of a distance d, between the mounting legs 22 as shown in FIGS. 7 and 8 so that the fuse holding clip 12 is stably positioned on the circuit board 36.

Figure 5:
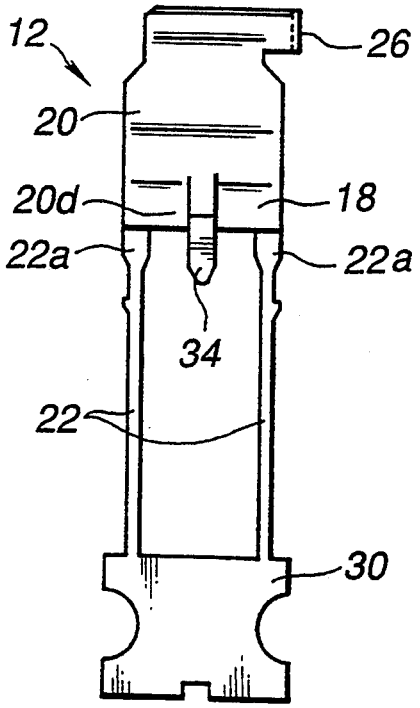
FIG. 5 is an enlarged front view of one fuse holding clip strip portion cut off from the clip strip of FIG. 3.
Figure 6:
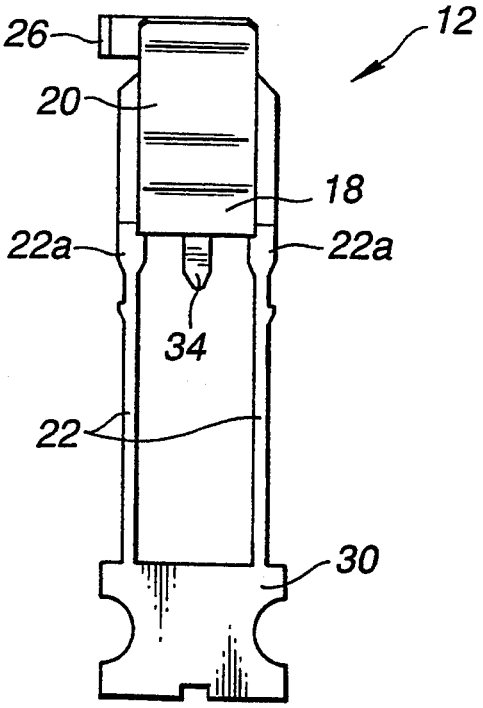
FIG. 6 is an enlarged back view of the clip strip portion of FIG. 5.

Also, the direction detector 34 may preferably have a length substantially equal to a length of a base portion 22*a* of the two mounting legs 22 as shown in FIGS. 5 and 6 so that the whole fuse holding clip 12 is positioned in a balanced manner and so that the operation of cutting the leg can be omitted.

Figure 8:
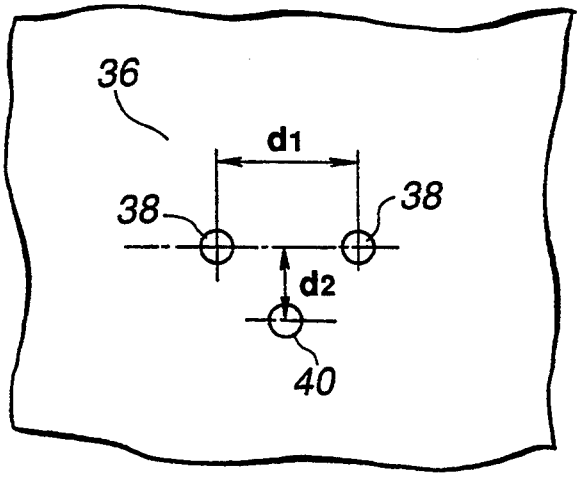
FIG. 8 is an upper view of a portion of a circuit board having two mounting holes through which mounting legs of the fuse holding clip are to extend and an extending hole through which a direction detector is to extend.
Figure 9:
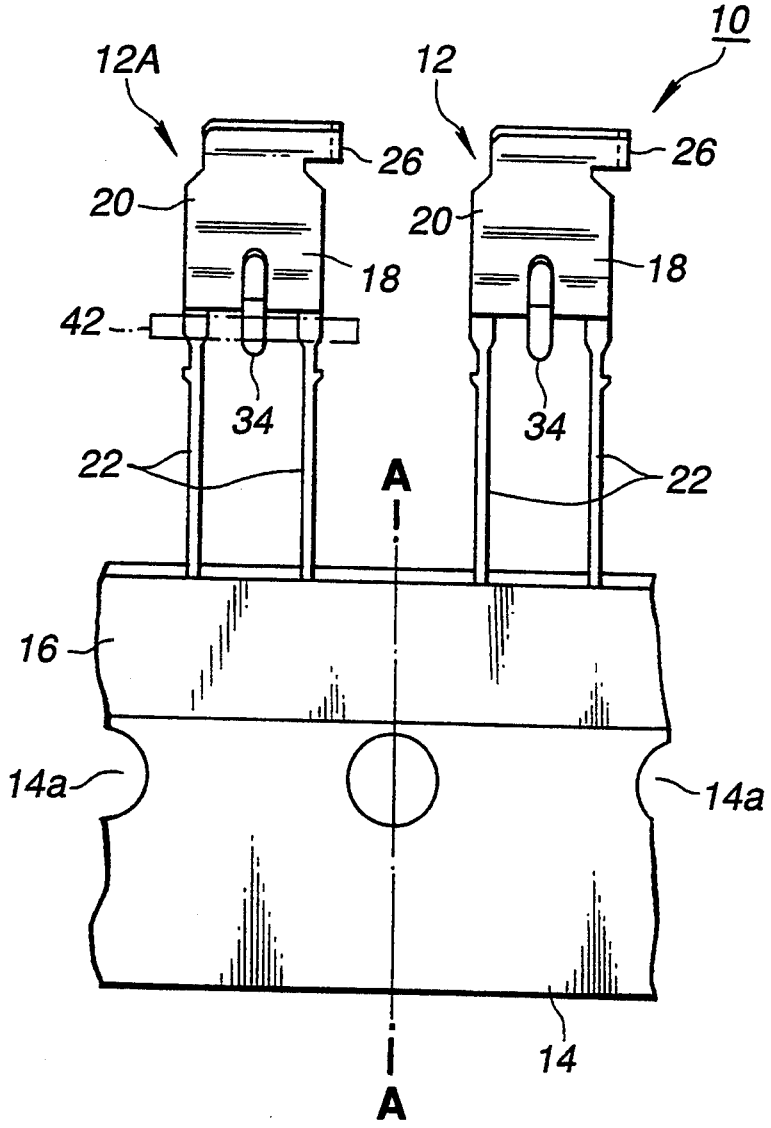
FIG. 9 illustrates in a front view a first step of cutting off a leading fuse holding clip from the remaining fuse holding clip assembly.

As shown in FIG. 8, a circuit board 36 on which the fuse holding clips 12 are to be mounted has two mounting holes 38 through which the mountimg legs 22 are to extend and a detection hole 40 through which the direction detector 34 is to extend. It should be noted that the detection hole 40 is so positioned that the direction detector 34 extends therethrough only when the mounting legs 22 of the fuse holding clips 12 are inserted into the mounting holes 38 in a correct direction.

Figure 19:
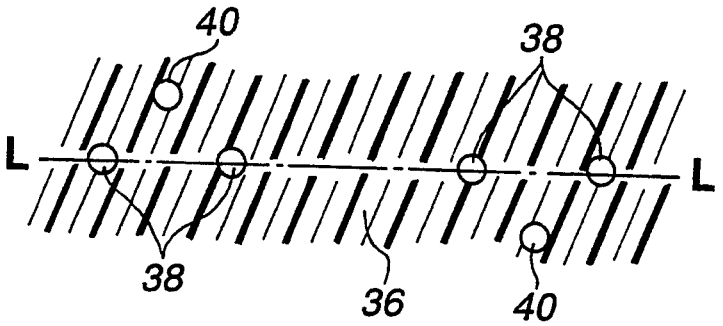
FIG. 19 is a horizontally sectional view of the circuit board for illustrating a pair of hole trains through which the mounting legs and the direction detector for a single fuse holder extend.
Figure 20:
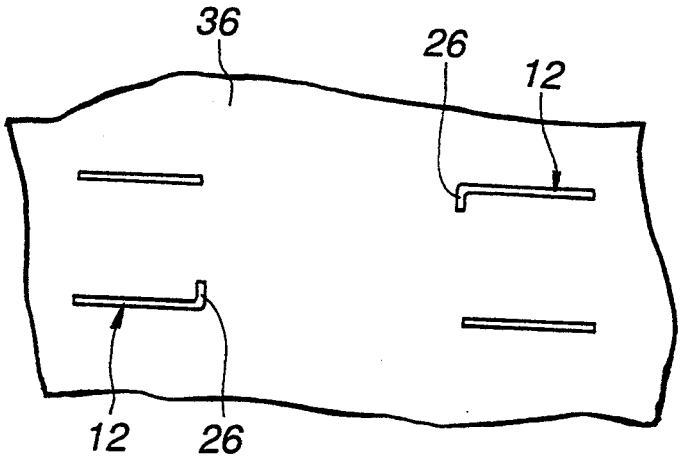
FIG. 20 schematically illustrates the fuse holder mounted on the circuit board in the incorrect direction.

Thus, it will be noted that since the base engaging tabs 26 are provided on the clip bodies 18 of the corresponding fuse holding clips 12 on the side having the corresponding base engaging tab 26, the detection holes 40 through which the direction detectors 34 for the pair of fuse holding clips 12 are to extend are positioned on the side opposite to each other relative to the line L—L bonding four mounting legs 22 of the two fuse holding clips 12 as shown in FIG. 19.

The fuse holding clips 12 can be mounted on the circuit boards 24 in a manner as described hereinjustbelow with reference to FIGS. 9 to FIG. 15.

The tape-like clip assembly 10 is fed by a sprocket type feeder to a predetermined operating position where the automatic part inserting machine is operated to mount the respective fuse hloding clips 12 on the corresponding circuit board 36. An inserting chuck 48 of the automatic part inserting machine not shown grasps the leading fuse holding clip 12A of the tape-like clip assembly 10 of FIG. 9 while a cutter (not shown) of the automatic part inserting machine cuts the supporting and adhering tape portions 14 and 16 along a line A—A of FIG. 9 so that the leading holding clip 12A is separated from the tape-like assembly 10.

Figure 10:
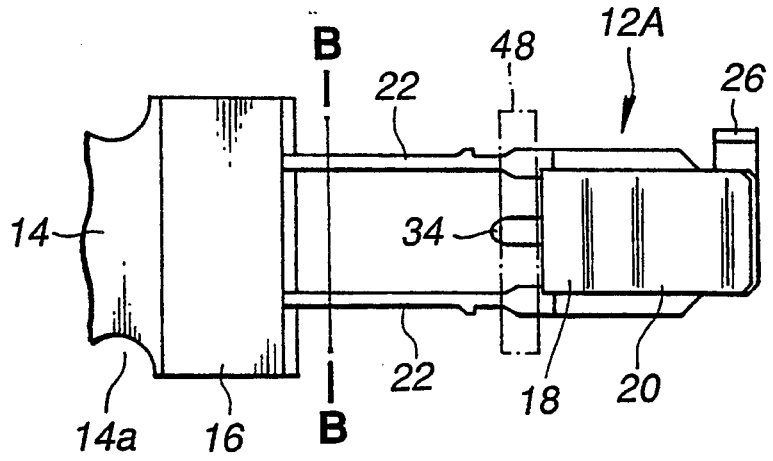
FIG. 10 illustrates in a front view a second step of cutting the mounting legs of the thus cut fuse holding clip out of a base portion.

Thereafter, as shown in FIG. 10, the fuse clip 12A is moved down by the inserting chuck 48 so that the mounting legs 22 of the fuse clip 12A are directed in a horizontal manner and reach the cutter which is to cut the tape portions 14 and 16. At that position, the cutter cuts the mounting legs 22 at portions adjacent to the tape portions 14 and 16 along a line B—B of FIG. 10 so that the mounting legs 22 are removed away from the tape portions 14 and 16.

Figure 11:
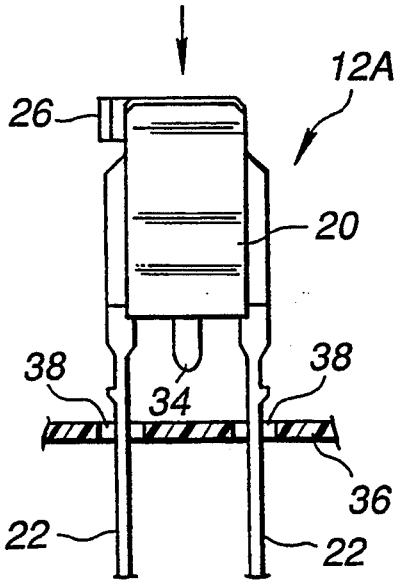
FIG. 11 illustrates in a front view the mounting legs being inserted into the mounting holes in the circuit board.
Figure 12:
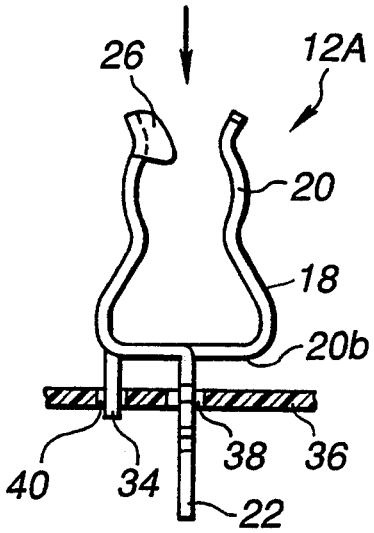
FIG. 12 illustrates in a side elevational view the mounting legs being inserted into the mounting holes in the circuit board in a correct direction.
Figure 13:
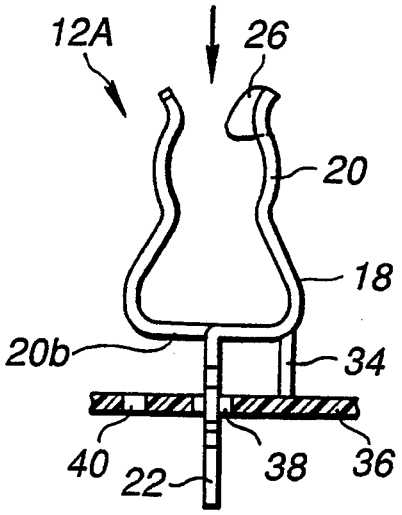
FIG. 13 illustrates in a side elevational view the mounting legs being inserted into the mounting holes in the circuit board in an incorrect direction.

As shown in FIGS. 11 through 13, the thus separated fuse holding clip 12A is carried by the inserting chuck 48 above a position where the fuse holding clip 12A is to be mounted and at its mounting legs 22 inserted into mounting holes 38 in a circuit board 36 by the inserting chuck 48, which in turn releases the fuse holding clip 12A.

Thereafter, a not shown inserting pusher of the inserting machine lowers the fuse holding clip 12A until the outer bottom 20*b* of the U-shaped curved piece 20 engages the upper face of the circuit board 36.

Figure 14:
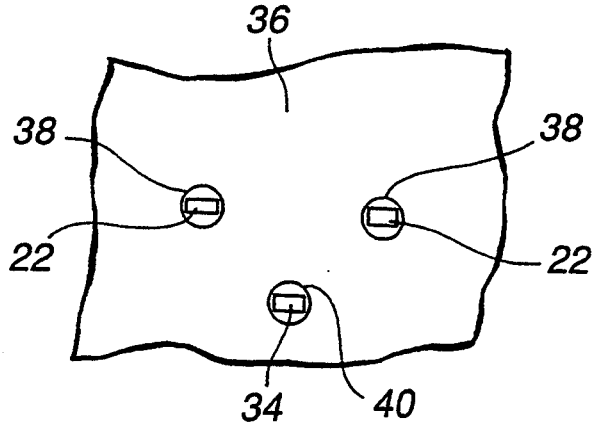
FIG. 14 is a bottom view of the circuit board through which the fuse holding clip is mounted in the correct direction.

In this case, as shown in FIGS. 12 and 14, if the fuse holding clip 12A is oriented in a correct direction, then the direction detector 34 can pass through the detection hole 40 so that the fuse holding clip 12A can be smoothly lowered. As a result, the mounting legs 22 of the fuse holding clip 12A can be inserted into the mounting holes 38.

Figure 15:
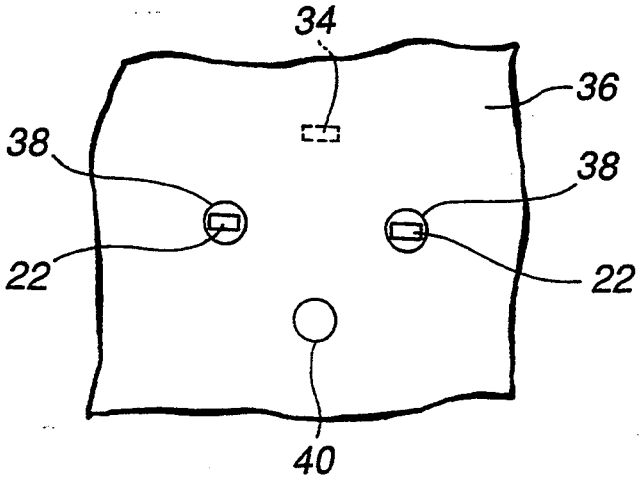
FIG. 15 is a bottom view of the circuit board through which the fuse holding clip is mounted in the incorrect direction.

On the other hand, as shown in FIGS. 13 and 15, if the fuse holding clip 12A is oriented in an incorrect direction, then the direction detector 34 strikes the circuit board 36 so that the fuse holding clip 12A cannot be lowered furthermore, which prevents the fuse holding clip 12A from being inserted into the circuit board 12 while it is oriented in the incorrect direction.

Thus, when the insertion error is detected by the direction detector 34 striking the circuit board 36, the automatic inserting machine can automatically stop.

At that time, the operator can correct setting a cartridge in which the fuse holding clip assembly 10 is contained or the program. Thus, the automatic inserting machine can start again immdeiately. Since the mounting legs 22 of the fuse holding clip 12A is never inserted in the incorrect direction, the operation of removing it out of the circuit board 36 is unnecessary for again inserting it in the correct direction, which causes the operation of mounting the fuse holder to be more effectively made.

Figure 16:
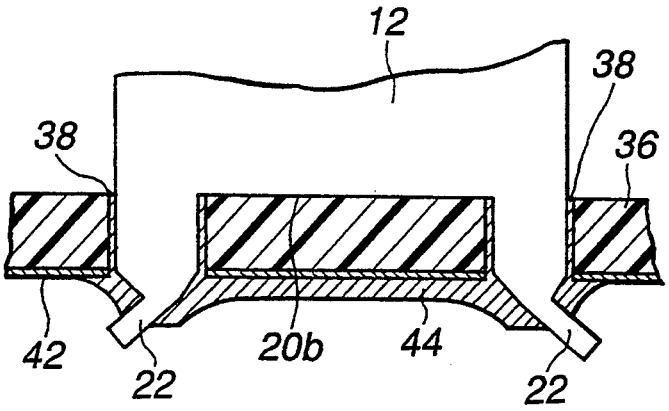
FIG. 16 is a cross sectional view of the circuit board on which the fuse holding clip is mounted with the mounting legs secured by a soldering layer.
Figure 17:
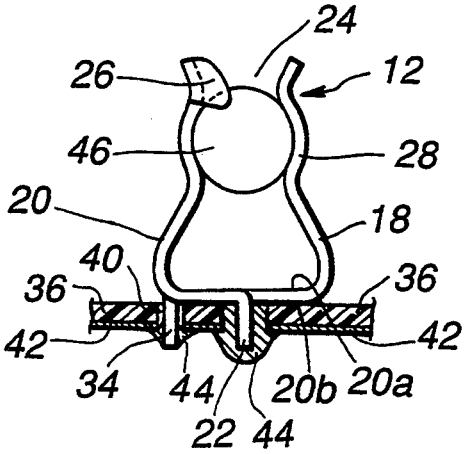
FIG. 17 illustrates the fuse holding clip completely mounted on the circuit board.

Furthermore, as shown in FIGS. 16 and 17, a cutter and clincher (not shown) of the automatic part inserting machine cuts the mounting legs 22 of the fuse holding clip 12A at its portion just below the circuit board 36 on the lower face thereof and clinches the thus projected mounting legs 22 of the fuse holding clip 12A.

Finally, the direction detector 34 as well as the mounting legs 22 of the fuse holding clip 12A are soldered onto the electrically conducting layer 42 on the circuit board 36 by an automatic soldering machine also not shown, so that the mounting legs 22 of the fuse holding clip 12A together with the direction detector.34 are electrically and mechanically connected to the electrically conducting layer 42. As shown in FIGS. 16 and 17, a solder 44 is filled around the mounting legs 22 in the holes 38 as well as provided around the projected mounting legs 22.

The succeeding fuse holding clips 12 of the tape-like clip assembly 10 can be also mounted on the circuit board 36 at the respective corresponding position thereof in the same manner as desrcibed with respect to the leading fuse holding clip 12A.

A fuse holder is formed by spacing a pair of fuse holding clips 12 to each other with the base engaging tabs 26 thereof symmetrically positioned so that the base engaging tab 26 of one of the spaced clips 12 is disposed opposite to that of the other clip 12.

A cartridge fuse 46 can be held by the fuse holder by inserting it through the base receiving openings 24 of the spaced fuse holding clips 12 and receiving the bases of the fuse onto the round portion 28 of the U-shaped curved piece 20 in a manner spaced from the inner bottom 20*a* thereof as shwon in FIG. 17.

Although a single embodiment of the invention has been described and illustrated with reference to the accompanying drawings, it will be understood by those skilled in the art that it is by way of example, and that various changes and modifications may be made without departing from the spirit and scope of the invention, which is defined only to the appended claims.

What is claimed is;

1. A method of mounting fuse holding clips for a fuse holder on a circuit board by an automatic part inserter which inserts mounting legs of said fuse holding clips into respective mounting holes in a circuit board, said fuse holding clips each having a stop provided on a clip body of said fuse holding clips so that a cartridge fuse held by said fuse holder is never axially removed therefrom out thereof, said method being characterized by comprising a step of inserting a fuse holding clip by the automatic inserter while a direction detector provided on said fuse holding clip extends through a detection hole in said circuit board if said fuse holding clips are inserted in a correct direction.

2. A method of mounting fuse holding clips for a fuse holder as set forth in claim 1, and wherein said direction detector is in the form of short leg.

3. A method of mounting fuse holding clips for a fuse holder as set forth in claim 2, and wherein said direction detector in the form of short leg is set so as to be biased relative to a line bonding said mounting legs.

4. A method of mounting fuse holding clips for a fuse holder as set forth in any of claims 1 through 3, and wherein said fuse clips are provided by cutting a fuse holding clip assembly in the form of tape which has a plurality of fuse holding clips assembled in a spaced manner.

5. A fuse holding clip for a fuse holder comprising a resilient fuse holding clip body including a generally U-shaped curved piece and mounting legs integrally provided on said curved piece to extend through mounting holes in a circuit board, said fuse holding clip characterized by comprising a direction detector provided on said clip body so as to extend through a detection hole in said circuit board if said fuse holding clip is mounted on said circuit board in a correct direction.

6. A fuse holding clip for a fuse holder as set forth in claim 5, and wherein said direction detector is in the form of short leg.

7. A fuse holding clip for a fuse holder as set forth in claim 6, and wherein said direction detector in the form of short leg is set so as to be biased relative to a line bonding said mounting legs.

8. A fuse holding clip assembly in the form of tape which has a plurality of fuse holding clips assembled in a spaced manner, and each of said fuse holding clips comprising a resilient fuse holding clip body including a generally U-shaped curved piece and mounting legs integrally provided on said curved piece to extend through mounting holes in a circuit board, said fuse holding clip characterized by comprising a direction detector provided on said clip body so as to extend through a detection hole in said circuit board if said fuse holding clip is mounted on said circuit board in a correct direction.

* * * * *